United States Patent [19]

Baski

[11] 4,298,065

[45] Nov. 3, 1981

[54] PITLESS ADAPTER

[76] Inventor: Henry A. Baski, 1586 Robb Way, Denver, Colo. 80226

[21] Appl. No.: 99,831

[22] Filed: Dec. 3, 1979

[51] Int. Cl.[3] ..... E21B 43/00

[52] U.S. Cl. ..... 166/88; 166/115

[58] Field of Search ..... 166/88, 89; 417/44, 417/45

[56] References Cited

U.S. PATENT DOCUMENTS

| | | | |
|---|---|---|---|
| 2,657,633 | 11/1953 | Baker et al. | 166/115 |
| 3,054,022 | 9/1962 | Baker | 417/44 |
| 3,123,689 | 3/1964 | Baker | 417/44 |
| 3,154,148 | 10/1964 | Peterson | 166/88 |
| 3,165,070 | 1/1965 | Baker | 417/45 |
| 3,380,533 | 4/1968 | Andrew | 166/88 |
| 3,519,073 | 7/1970 | Shetler | 166/89 |

*Primary Examiner*—James A. Leppink

*Attorney, Agent, or Firm*—Richard D. Law; Bruce G. Klaas

[57] ABSTRACT

A generally uniform diameter pipe secured to the top of a well casing providing a seat for a spool having spaced plates and a flow directing central space to a lateral distributing pipe, with the plates having peripheral sealing means against thin sealing seats on the inside of the pipe, and a central spool pipe arranged for either a turbine drive for a pump or a submerged pump. The spool being arranged for easy seating in or withdrawal from the outer pipe for service.

4 Claims, 8 Drawing Figures

PITLESS ADAPTER

This invention relates to pitless adapters and particularly to the removable portion of a well which is mounted between ground level and a well casing, arranged to provide at least one underground distribution line.

In some types of a well, the well casing, normally of tubular form, extends vertically from the production zone or zones to near the surface. Lateral distribution from the well is provided by an underground line below the frost level for the particular area. A pitless adapter provides a connecting device between the well casing and the surface, provides seals for the line from the well to the lateral distribution line, and provides the sealed joint for the pump actuator or the pump motor electric lines. In instances of well and pump maintenance, the elements of the pitless adapter must be removed for the withdrawal of the pump or pump-motor assembly.

The well fluid, usually water, is pumped to the distribution point by a pump which may be a turbine-type pump or a submerged pump. In the former, a shaft, rotated by an above ground motor, extends through the pitless adapter, down the production pipe (also called a drop pipe) to a rotary pump. In the submerged type, a totally enclosed motor and close-coupled pump are submerged in the well fluid, and power lines from the surface provide operating power. In either case, the elements extending through the pitless adapter must be sealed, and head of the casing sealed so that pumped liquid is forced out the laterals.

OBJECTS AND ADVANTAGES OF THE INVENTION

It is, therefore, among the objects and advantages of the invention, to provide a simplified pitless adapter using standard components for major parts of the adapter.

Another object of the invention is to provide a pitless adapter arranged for use for a turbine pump as well as a submerged pump-motor assembly.

Yet another object of the invention is to provide a pitless adapter which is adequately sealed, by stainless steel seals, and which components are easily removed therefrom, having a flange cap for up left of the components, and provide a working surface.

Still another object of the invention is to provide a pitless adapter for large size pipes and casings, usually above about four inches.

A further object of the invention is to provide a drop pipe fitting for easy assembly in and out of a pitless adapter.

These and other objects of the invention may be ascertained by reference to the appended drawings and the following specification.

GENERAL DESCRIPTION OF THE DRAWINGS

DETAILED DESCRIPTION OF THE DRAWINGS

Figure 1:
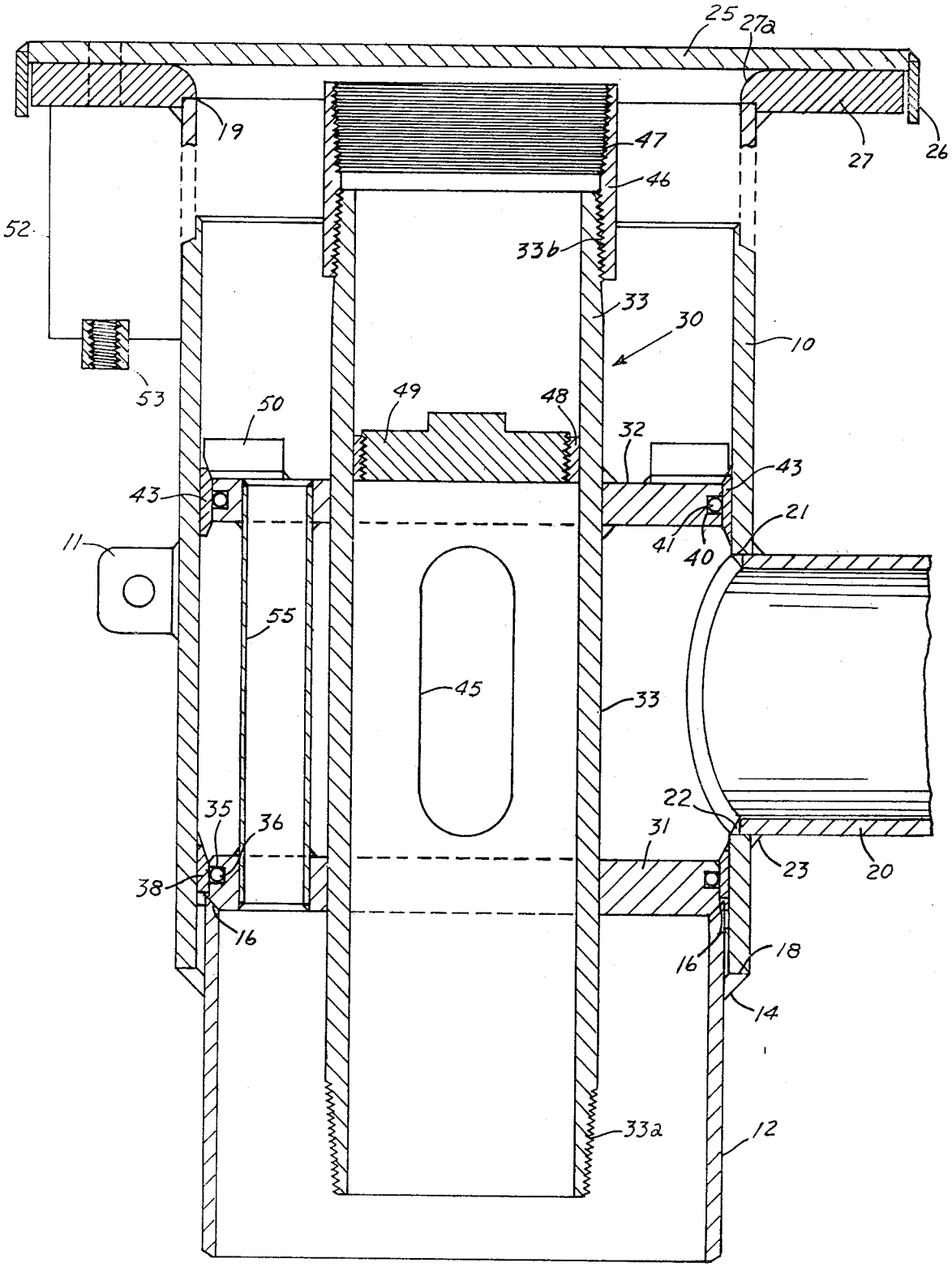
FIG. 1 is a cross-sectional view of one form of pitless adapter, according to the invention, arranged for a submerged pump-motor.

In the device of FIG. 1, an outer pipe 10 for a pitless adapter is securely fastened to a connector 12 which is fastened by a weldment, threads, compression fit, etc. 14. The connector is secured to a well casing, not shown. The top 16 of the tube 12 extends above the lower end 18 of the outer pipe 10. A lateral distribution pipe 20 is secured in hole 21 in the outer pipe 10 by weldments 22 and 23, forming a waterproof joint. A cap 25, with an outer downwardly directed flange 26 is seated on the upper end 19 of the pipe 20. The cap includes an annular flange 27 sealed on the end 19. The cap may include a central breather, as one similar to 28 of FIG. 7. A threaded access hole with a plug may be provided as is conventional. A pressure tap may be provided in plate 32, as by a tapped hole and plug (not shown) which is conventional.

The pipe portion 10 is a straight tubular pipe having an inside diameter considerably in excess of 4 inches and preferable above 8 inches. The pipe section is essentially a full interior diameter from its top to the top of the connector 12, arranged to accept a sealing spool (shown generally by numeral 30), which may be simply entered in or withdrawn by straight up and down movements. The spool 30 includes annular plates 31 and 32 which are spacedly secured to a central pipe 33, as by welding or the like. The lower plate 31 is arranged to seat on the top of the tube 12 and be held thereby. This plate includes a circumferential groove 35 housing an O-ring seal 36 which seals against a stainless steel annular ring 38 secured to the interior of the pipe 10 below the lateral outlet 20. This seals the upper portions of the seal from the casing. Plate 32 includes a circumferential groove 40 housing an O-ring seal 41 sealing against a stainless steel ring 43 secured to the interior of the pipe 10 above the lateral pipe 20. A port 45, or a series of ports, provides communication with the spool space between the plates 31 and 32 and communicates with the lateral 20. The center pipe 33 is provided with threads **33*a* at the lower end for attachment to the drop pipe of pump and threads 33*b* at the upper end. A coupling 46 is secured to upper end by threads, which may, also, be welded. The coupling 46 includes upper threads 47, into which may be threaded a alifting tool for pulling or setting the drop pipe and spool. A threaded seat 48 is welded on the interior of the center pipe 33 near its upper end, and is closed by a plug 49. Bracing blocks (or an annular ring) 50 may be welded on the top of top plates or the bottom of the bottom plate for stability of the spool while being moved in and out of the tube 10**.

For a submerged pump, a power line entrance box 52, with a threaded inlet 53, directed downwardly, provides means for bringing the power line into the adapter. The lines (not shown) are passed through the spool by means of a access tube or opening 55 welded in aligned openings in the two plates of the spool. This opening permits any water which accidently gets in top of the adapter to flow back into the well, as well as providing passage for the power line. In a flowing well there is no opening, being sealed by a sealing compound around the power lines. A lifting lug (or a series of circumferential lifting lugs) secured to the cap provides easy handling of the adapter pipe for installation, etc.

Figure 7:
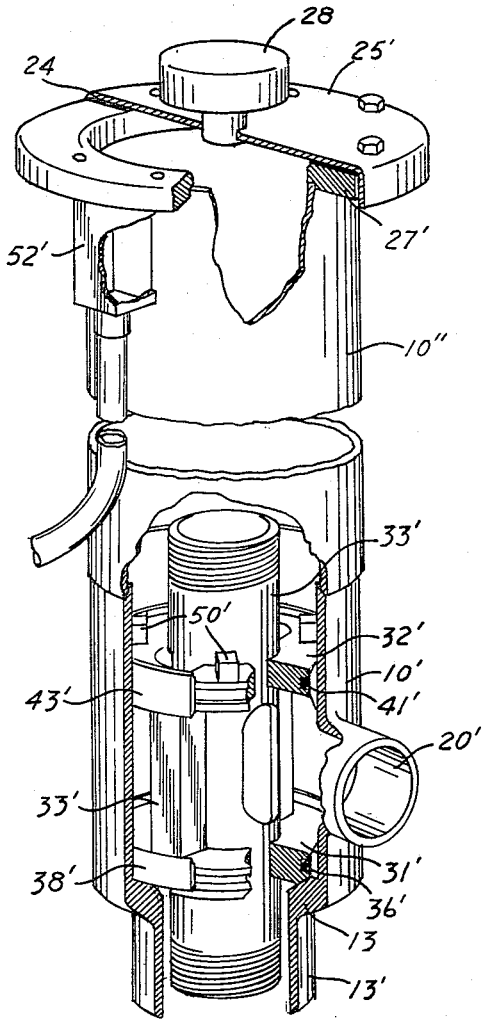
FIG. 7 is a partially cut-away perspective of a modified pitless adapter for a submerged pump.

A modified pitless adapter, FIG. 7, for submersible pumps includes a heavy wall housing tube 10'' with a welded-on side discharge 20'', which may be threaded, flanged, welded or the like to a lateral water line. The housing includes a shoulder 13 secured to the end of connector 13' which is welded to a well casing. An upper stainless steel ring 43' and a lower stainless steel ring 38' are welded in the housing to mate with O-rings 41' and 36' respectively. The O-rings are mounted in the periphery of spool flanges 32' and 31' respectively mounted on spool tube 33'. The tube is threaded on upper and lower ends as in FIG. 1. An upper housing tube 10'', supplied by the installer or manufacturer, is provided to position the spool at the correct depth underground, is welded to housing tube 10'. A flange 27' seats on the top of the casing 10'' supporting a cover 25' with a flat, annular gasket 24 for sealing. An air vent 28, centrally located, communicates through the cover with the chamber of the housing. An electrical junction box 52' provides electric service to the adapter. Four centering blocks 50' help stabilize the spool and help prevent damage to the O-ring during insertion or removal of the spool.

Figure 2:
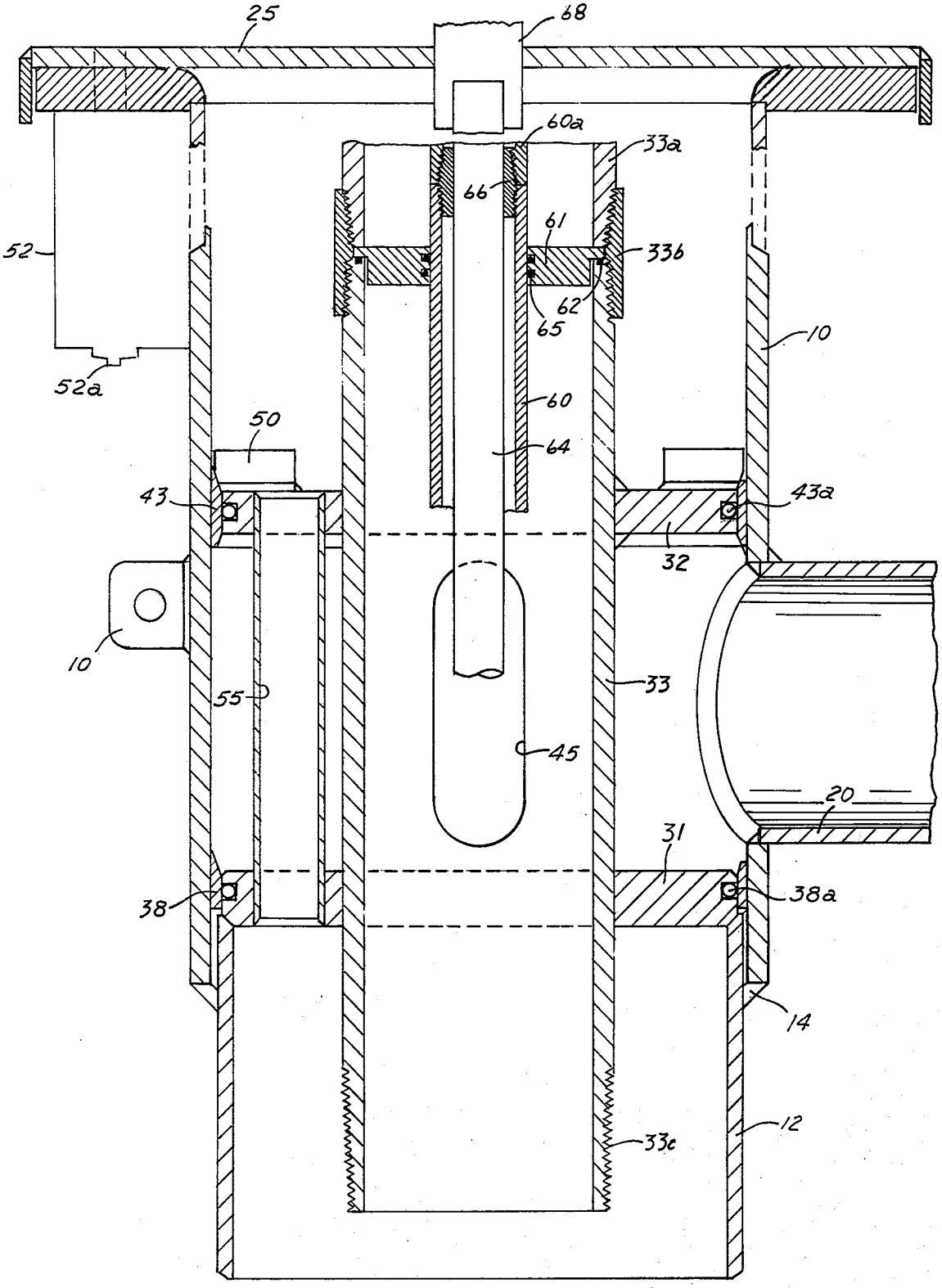
FIG. 2 is a cross-sectional view of the adapter of FIG. 1, modified for a turbine drive for a well pump.

The adapter is arranged to utilize a water lubricated turbine pump as shown in FIG. 2. For this purpose, the plug 49 and ring 48 is removed, and a sleeve bearing 66 is threaded to the top of threaded pipe 60, housing pump shaft 64. This is threaded to outer support tube **60*a* secured by an anchor (not shown). The shaft is connected to drive coupling 68. The turbine shaft 64 is mounted in tube 60 which is sealed by O-rings 65 in plate 61 secured on the top of tube 33 by coupling 33*b* and sealed by O-ring 62. A tube 33*a* is secured in coupling 33*b*. Tube 33 is threaded at 33*c*. The coupling 8 is normally connected to the shaft of an electric motor (not shown) mounted on the cap. The shaft, of course, extends down the drop pipe to the rotary pump. The top cover 25 is shown with an electric inlet box 52 with power line connector 52*a***. These are not normally used for a turbine pump, but it illustrates the versatility of the unit for adaption to either type of pump.

Figure 8:
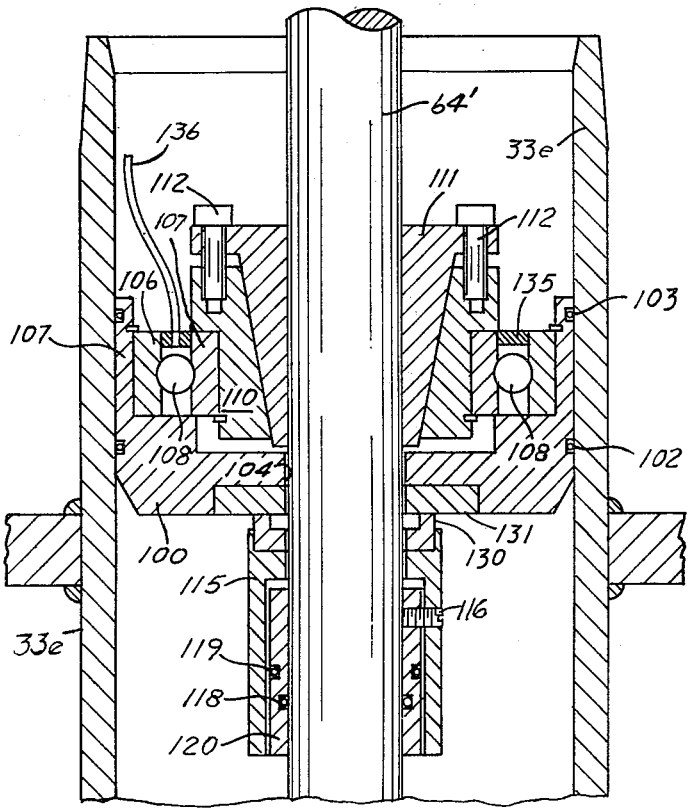
FIG. 8 is a cross-sectional view of shaft seal and bearing set of a turbine pump shaft, adapted to a pitless adapter according to the invention.

A modified seal and bearing arrangement is shown in FIG. 8, where a spool tube **33*e* has a cup-shaped bearing mount 100, sealed by O-rings 102 and 103 to the inside of the tube, with a bore 104 for a shaft 64'. A bearing set, including outer race 106 and inner race 107 support ball bearings 108 for free rotation of the inner race. The inner race is secured to a collar 110 which is mounted in a tapered lock collar 111 frictionally secured in position on the shaft. The taper lock is bolted by bolts 112 to the collar 110 so that the collars rotate with the shaft on the bearing set. An extension tube 115 is frictionally secured to the shaft 64' provides for static sealing of the sleeve 120. The sleeve 115 and the shaft 64' which rotate together. Tube 115 is secured by set screw 116 to tube 120, and O-rings 118 and 119 seal the two. The dynamic seal is provided by a ring seal 130 against stationary seat 131. The ring seal 130 is frictionally held in tube 115. A grease line 136 from the surface through seal 135** to the space in the bearing set provides greasing form the surface.

Figure 3:
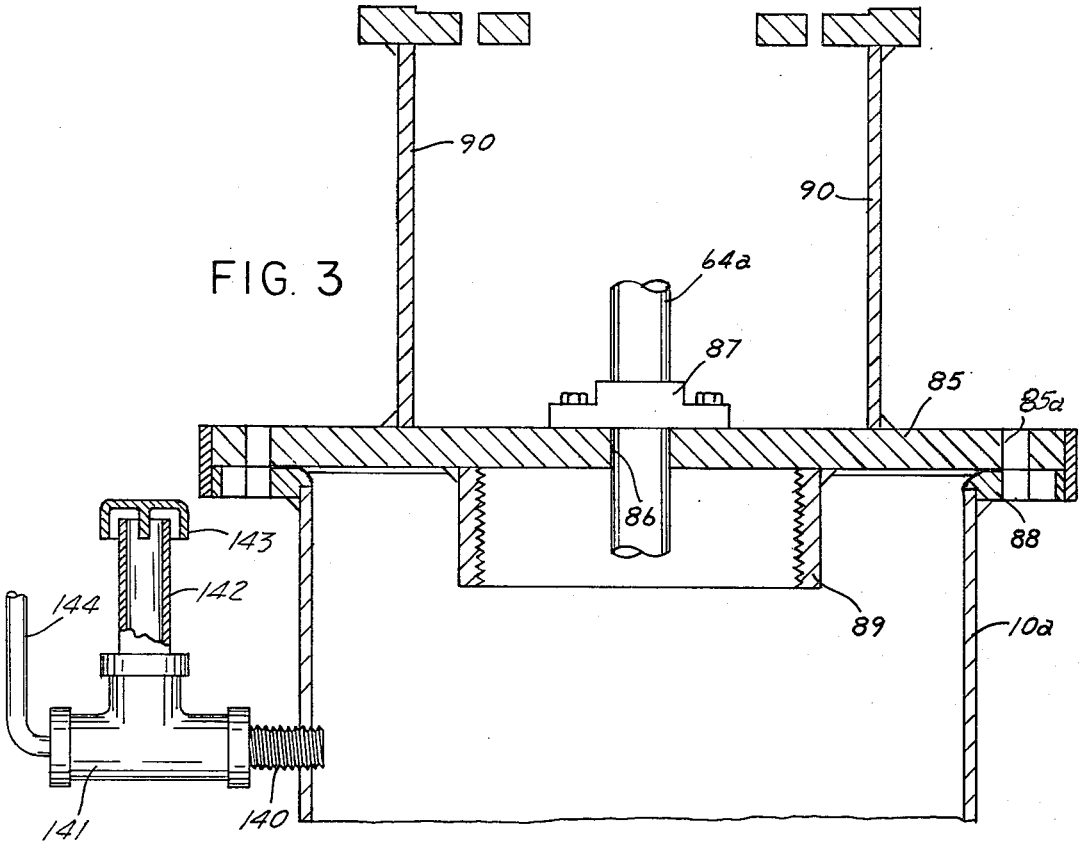
FIG. 3 is a cross-sectional view of a modified form of pitless adapter.

For turbine pumps, an electric motor may be mounted on the cap of a pitless adapter, and one method is shown in FIG. 3. A cap 85 is provided with a central bore 86 and sealing journal 87 covering the same and holding a shaft **64*a*. The cap seats on holed flange 88 welded to the top of pipe 10*a*. The cap is provided with bolt holes 85*a* for attachment to the flange. A threaded center pipe support 90 is welded on the inside of the cap. A motor mount 90 is welded to the top of the cap, and it is arranged to have a motor bolted to it. A close nipple 140 may be secured in the side of the tube 10*a* and tee 141 secured thereto. A stand pipe 142 with a breather cap 143 is mounted on the stand pipe. An air hose 144** may be secured to remaining opening of the tee.

Figure 4:
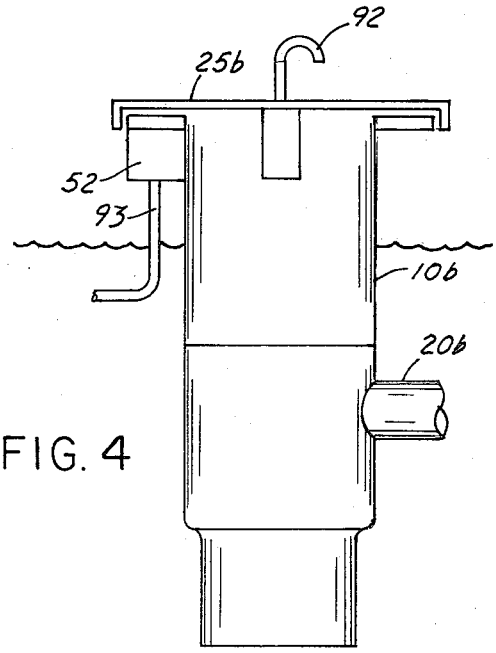
FIG. 4 is a cross-sectional view of a cap for a pitless adapter, arranged for a submerged well pump.

Schematically shown in FIG. 4, is a pitless adapter **10*b* with a lateral distribution pipe 20*b*. A cover 25*b* is provided with a breather 92 having a downwardly pointing opening discouraging weather moisture entrance. A power service entrance line 93 is connected to the entrance box 52** from the bottom.

Figure 5:
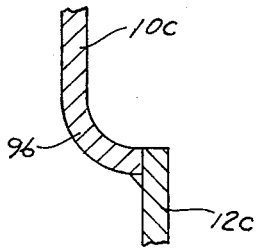
FIG. 5 is a cross-sectional detailed view of a portion of a connector for a well casing to a pitless adapter.
Figure 6:
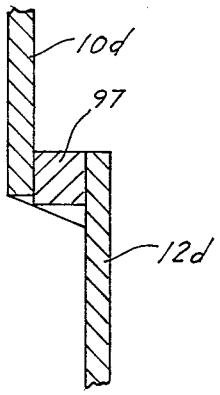
FIG. 6 is a cross-sectional detailed view of a modified connector for a well casing.

The connection of the outer pipe of the adapter may be connected in several ways to the well ring which is attached to the well casing. As shown in FIG. 5 an outer tube **10*c* of the pitless adapter has an inwardly, directed rounded shoulder 96 which is welded to the top of a bottom tube 12*c*, leaving a spool seat. A straight pipe section 10*d*, FIG. 6, may be welded to a spacer ring 97 which is welded to the top of the bottom tube 12*d***. This, also, provides a spool seat. The bottom tube is connected to the well casing as explained above.

The arrangement of the pitless adapter is stored as an "off the shelf" item, since, when made of steel, it may be cut to the desired length by common pipe cutters. The sealing rings may be made of stainless steel which are not easily damaged, and insure positive long life for the "O-rings". The outer pipe may be welded or clamped to the casing, with sealing members. The unit is best adapted to larger sizes of casings, from 6 to 36 inches. Since it is made from essentially stock items, it provides an inexpensive adapter, which is simply installed, easily maintained by substituting parts.

What is claimed is:

1. A pitless adapter arranged for either a turbine pump or a submerged pump, comprising:

(a) a full diameter pipe arranged to extend from above ground surface to a well casing and having a diameter larger than the well casing so as to telescope over a connector with the end of the connector extending into the lower end of said full diameter pipe forming a spool seat and said full diameter pipe being connected to said well casing;

(b) a lateral pipe distributor secured to said full diameter pipe adjacent said lower end of full diameter pipe;

(c) a spool mounted in said full diameter pipe including upper and lower plates and a central pipe having at least one communication port to said full diameter pipe and said lateral pipe, sealing means between the circumference of each said plate and said full diameter pipe;

(d) said central pipe including connecting means to a drop pipe at its lower end and pulling means at its upper end;

(e) means for sealing said central pipe preventing a flow of fluid out of its top, including a seal ring internally of said central pipe above said at least one port;

(f) means engaging said seal means sealing said central pipe against upward flow of well fluid;

(g) at least one spacer ring being mounted between said full diameter pipe and the lower plate;

(h) and cap means for closing the top of said full diameter pipe.

2. A pitless adapter according to claim 1, wherein thin peripheral seal rings are mounted in said full diameter pipe in position to seal against said O-rings when said spool is seated on the well casing.

3. A pitless adapter according to claim 1, wherein said means threadedly engaging said seal means in said central pipe is a plug, and drain means from the upper to the lower plate permits passage of power lines to a submerged pump in the well casing.

4. A pitless adapter according to claim 1, wherein said means threadedly engaging said seal means in said central pipe included a sealing journal for passing a turbine pipe drive shaft through said spool, said sealing journal having a tapered lock collar frictionally secured to said turbine pump drive shaft and rotatable in a bearing set mounted in said central pipe with a dynamic seal assembly rotatable with said turbine shaft supporting said bearing set.

* * * * *